United States Patent [19]

Johnson et al.

[11] Patent Number: 4,890,813

[45] Date of Patent: Jan. 2, 1990

[54] ANTI-TIP BRACKET FOR RANGES

[75] Inventors: Chris Johnson, Goodlettsville; Larry Keefover, Springfield; Buddy J. Austin, Portland, all of Tenn.

[73] Assignee: White Consolidated Industries, Inc., Cleveland, Ohio

[21] Appl. No.: 279,779

[22] Filed: Dec. 5, 1988

[51] Int. Cl.[4] ..... A47B 97/00

[52] U.S. Cl. ..... 248/680; 248/500

[58] Field of Search ..... 248/680, 681, 500, 501, 248/503.1, 650

[56] References Cited

U.S. PATENT DOCUMENTS 1,758,646 5/1930 Brown ..... 248/681
2,517,411 8/1950 Patterson ..... 248/500 X
4,055,320 10/1977 Bengtsson ..... 248/501
4,754,948 7/1988 Casciani ..... 248/680

*Primary Examiner*—Alvin C. Chin-Shue
*Attorney, Agent, or Firm*—Alfred E. Miller

[57] ABSTRACT

An anti-tip anchor bracket for a major home appliance, such as an electric or gas range with a front opening oven. The bracket is mounted on the floor and is provided with opposite side flanges to which the levelling feet of the appliance are slid under, thus preventing the appliance from tipping when an open oven door extending horizontal to the floor is stepped on or has excessive weight placed upon it. The bracket is also provided with a front flange which prevents the appliance from being inserted within the mounting bracket in an incorrect manner.

4 Claims, 1 Drawing Sheet

ANTI-TIP BRACKET FOR RANGES

The present invention relates to a device associated with a free standing domestic appliance and preventing the tipping over of the appliance when the front door is opened to a position which is generally horizontal to the floor and weight is applied to the outer edge of the door, for example, by means of a person stepping on the door to cause the appliance to tip forward, thus causing injury to the person who has stepped on the door.

The problem of tipping or rotating appliances is nown and several solutions have been proposed. For example, U.S. Pat. No. 4,669,695 to Chou and U.S. Pat. No. 4,754,948 to Casciani. Although the solutions proposed in these prior art patents are directed to the solving of this problem, the present invention is simpler in construction and easier to install. It should be apparent that the solutions to the problem set forth in both the Chou and Casciani patents involve the mounting of brackets on the walls or floors together with projections which are adapted to be insertend through openings in the rear wall of the appliance that have to be fashioned for this purpose. The present invention, on the other hand, requires simply a bracket that is screwed, nailed or otherwise affixed to a floor in the location where the appliance is to be set, and no holes or openings in the appliance or other attachments for securing the appliance to the bracket are required. In other words, the free standing appliance does not have to be altered in any way in order to receive the mounting brackets for preventing the tipping of the appliance upon the application of excess weight to an open front door of the appliance.

It is the furthr object of the present invention to provide an anti-tip bracket for a free standing appliance, such as an electric or gas range having levelling feet, and in which the bracket is provided with a front blocking flange whereby the appliance can only be slid into the correct mounting position whereby the levelling feet are slid under oppositely directed horizontal flanges to thereby entrap the feet within the mounting bracket. This arrangement prevents the free standing appliance from tipping in the direction of the person stepping on, or otherwise applying weight, to the horizontally disposed open front door.

In order that the present invention will be more clearly understood, it will now be disclosed in greater detail with reference to the accompanying drawings in which.

DESCRIPTION OF THE PREFERRED EMBODIMENT

Figure 1:
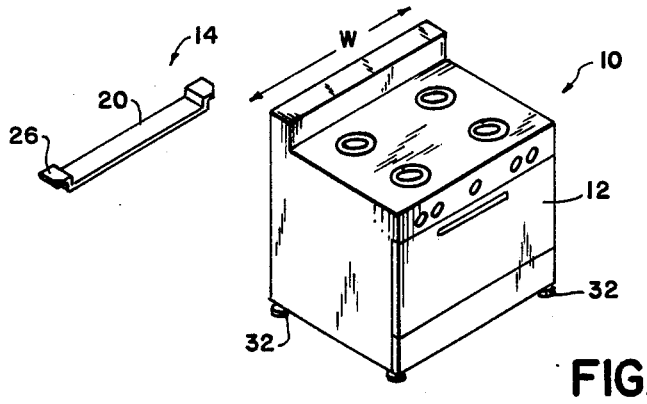
FIG. 1 is an exploded perspective view of the anti-tip bracket for a major appliance.
Figure 2:
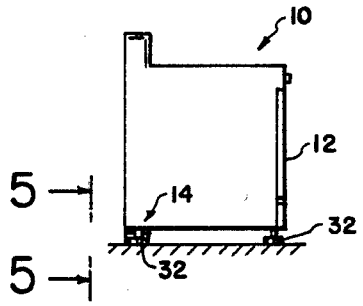
FIG. 2 is a side elevational view of the major appliance being affixed to the mounting bracket.
Figure 3:
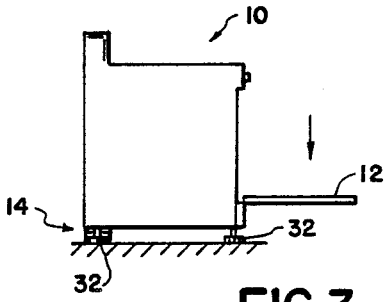
FIG. 3 is the same view as shown in FIG. 2, however, with the front door of the appliance being open and in a horizontal position.

As seen in FIG. 1, a major appliance such as a range having an oven, which could be operated either from a supply source such as electric or gas. The appliance is referred to generally by the reference numeral 10, and has a front accessible door 12, which when in the open position assumes a generally horizontal position, as seen in FIG. 3. Since the door 12, in its open position, is close to the level of the floor, there is a strong tendency for a person to step on the door and then attempt to reach above the appliance to create a moment of force which tends to tip the range, or other major appliance, in a clockwise direction, thereby causing injury to the person. In order to prevent this occurence, an anti-tip bracket identified generally by the reference numeral 14 is utilized. This anti-tip or anchor bracket is secured to the floor, for example, by means of screws 16 passing through openings 18.

Figure 4:
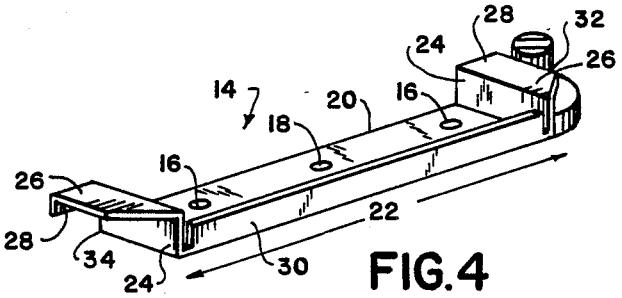
FIG. 4 is an enlarged perspective view of the anti-tip bracket showing an adjustable foot of the appliance being inserted under the horizontal flange of one end thereof.
Figure 5:
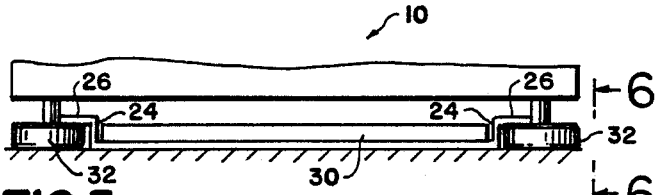
FIG. 5 is an enlarged view taken along the lines 5—5 of FIG. 2 showing the major appliance in position with the adjustable feet under the horizontal flanges at opposite ends of the anti-tip bracket.
Figure 6:
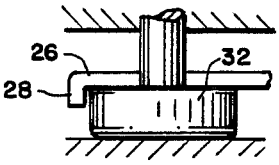
FIG. 6 is a view taken along the lines 6—6 of FIG. 5.

As seen in FIGS. 4–6, the bracket is provided with a main body portion 20 which has a width 22 that corresponds to the width W of the appliance 10. The opposite ends of the body portion 20 of the bracket are provided with upstanding walls 24 and horizontally disposed flanges 26. Furthermore, each of the flange 26 are provided with downturned tabs 28, the purpose of which will be hereinafter described. In addition, a vertical flange 30 is provided at the front of the bracket, the purpose of which will be also described hereinafter.

Appliance 10, like most major appliances, is provided with levelling legs 32, which can be adjusted to ensure the stability of the appliance once it is mounted in place. Since the width W of the appliance corresponds to the width 22 of the anti-tip anchor bracket 14, and since the outer periphery of the level legs are in a plane that corresponds to the corresponding side surface of the appliance 10, the levelling legs can be snugly slid within the space 34 bounded by the upstanding wall 24 and the horizontal flange 26 of the bracket 14.

It should be evident that the range can only be inserted within the space 34 in a proper manner since the vertical flange 30 at the front of the bracket will prevent the adjustable levelling legs 32 from entering the anti-tip bracket space 34 until the appliance 10 is perfectly aligned with the bracket 14. When this occurs and the adjustable levelling legs 32 are slid within the space 34, the legs 32 are prevented from being pushed rearwardly out of the bracket by means of the tabs 28 which function as stops, thus limiting the travel of the appliance within the bracket 14.

Once the major appliance 10 is correctly mounted within the anti-tip anchor bracket 14, the bracket will prevent the range from tipping when a load of up to 250 pounds is placed upon the open oven door. It should be apparent that in order to remove the appliance from the anti-tip bracket, it is merely slid forward so that the rear levelling legs clear the horizontal flnges 26.

Consequently, the present anti-tip mounting bracket is considerably easier to install and to use in connection with major appliances such as electric or gas ranges with front opening doors.

While the invention has been disclosed and described herein with reference to several embodiments thereof, it is apparent that other variations and modifications of my invention may be made which fail within the true spirit and scope of the invention as defined in the following claims.

We claim:

1. A combination of a an anti-tip bracket and rear levelling feet for a major appliance, said appliance having a front door which is adapted to be opened to a position substantially horizontal to a floor comprising: said bracket having an elongated body portion provided with opposite vertically extending end walls, means for securing said bracket to the floor, a horizontal flange extending outwardly from each end wall in opposite directions forming a confined space between each horizontal flange and the respective adjacent floor surface, the distance between said rear levelling feet being substantially the same distance between the end walls of said body portion of the bracket said horizontal flanges engaging respective rear leveling feet when the rear levelling feet of said appliance is moved toward said bracket and each of the rear levelling feet correctly slide in the respective confined space so that the appliance is prevented from tipping when an unbalancing load is applied to said door.

2. The combination a claimed in claim 1 further comprising a vertically extending front flange on said body portion of said bracket for ensuring the alignment of each of the rear levelling feet in the respective confined space.

3. The combination as claimed in claim 1 further comprising a rear downwardly extending tab on each horizontal flange which functions as a stop for each of the rear levelling feet when slid into a respective confined space.

4. The combination as claimed in claim 1 wherein said appliance can be slid out of said bracket without first removing securing means for said bracket.

* * * * *